US009771246B2

(12) United States Patent
Bond

(10) Patent No.: US 9,771,246 B2
(45) Date of Patent: Sep. 26, 2017

(54) WINCH APPARATUS AND METHOD OF USE THEREOF

(71) Applicant: Thomas Bond, Franklin, TN (US)

(72) Inventor: Thomas Bond, Franklin, TN (US)

( * ) Notice: Subject to any disclaimer, the term of this patent is extended or adjusted under 35 U.S.C. 154(b) by 282 days.

(21) Appl. No.: 14/840,328

(22) Filed: Aug. 31, 2015

(65) Prior Publication Data

US 2017/0061771 A1 Mar. 2, 2017

(51) Int. Cl.

| | |
|---|---|
| ***G08B 21/00*** | (2006.01) |
| ***B66D 3/14*** | (2006.01) |
| ***B66D 3/02*** | (2006.01) |
| ***B66D 1/58*** | (2006.01) |

(52) U.S. Cl.

CPC ..... *B66D 3/14* (2013.01); *B66D 1/58* (2013.01); *B66D 3/02* (2013.01)

(58) Field of Classification Search

CPC .. B65H 2701/31; G08B 13/08; G08B 13/122; B66D 3/02; B66D 1/58

USPC ..... 340/668, 665, 548; 73/862.68, 862.42

See application file for complete search history.

(56) References Cited

U.S. PATENT DOCUMENTS

| | | | | | |
|---|---|---|---|---|---|
| 3,827,365 | A * | 8/1974 | Coppel | B65G 1/0414 | 104/127 |
| 4,039,084 | A * | 8/1977 | Shinohara | B66C 23/905 | 177/146 |
| 4,220,037 | A * | 9/1980 | Widehn | G01G 3/14 | 73/1.13 |
| 4,462,484 | A * | 7/1984 | Crudele | B66D 1/54 | 182/112 |
| 4,579,189 | A * | 4/1986 | Tanaka | B62K 25/286 | 180/227 |
| 5,160,055 | A * | 11/1992 | Gray | B66C 23/90 | 212/278 |
| 5,182,458 | A * | 1/1993 | McConachy | F03D 13/20 | 290/44 |
| 5,429,007 | A * | 7/1995 | Khachaturian | G01L 5/101 | 73/862.392 |
| 7,093,327 | B2 * | 8/2006 | Huang | B60P 7/0861 | 24/68 CD |
| 7,231,693 | B2 * | 6/2007 | Wilcox | B60P 7/0861 | 24/68 CD |
| 7,509,711 | B2 * | 3/2009 | Hsieh | F16G 11/12 | 24/68 CD |
| 8,166,831 | B2 * | 5/2012 | Ruan | B60P 7/083 | 73/862.42 |
| 2006/0277726 | A1 * | 12/2006 | Hsieh | B25B 25/00 | 24/68 R |
| 2013/0160254 | A1 * | 6/2013 | Stoddard | B60P 7/0861 | 24/68 CD |

(Continued)

*Primary Examiner* — Hoi Lau

(74) *Attorney, Agent, or Firm* — Patterson Intellectual Property Law, P.C.; Garrett M. Hausman

(57) ABSTRACT

A winch apparatus includes a frame; a support coupler mounted to the frame at a support end; an axle mounted to the frame; a sensor connected to the axle, detecting strain in the axle, and outputting a corresponding signal; a spool rotatably disposed around the axle and including a ratchet wheel and a receiving surface; an elongate flexible member received on the receiving surface and secured to the spool; a handle to actuate the spool and increase tension on the elongate flexible member and including a grip end and a mounting end rotatably mounted to the frame; and a pawl mounted to the handle and positioned to actuate the ratchet wheel.

20 Claims, 7 Drawing Sheets

(56) References Cited

U.S. PATENT DOCUMENTS

| | | | | |
|---|---|---|---|---|
| 2015/0027789 | A1* | 1/2015 | Ellis | B66F 9/065 177/1 |
| 2015/0027808 | A1* | 1/2015 | Baillargeon | B66F 17/006 182/3 |
| 2016/0003696 | A1* | 1/2016 | Longman | B62M 3/00 73/862.621 |
| 2016/0061676 | A1* | 3/2016 | Brown | G01L 5/0033 73/862.68 |
| 2017/0061771 | A1* | 3/2017 | Bond | B66D 3/02 |

* cited by examiner

WINCH APPARATUS AND METHOD OF USE THEREOF

BACKGROUND OF THE INVENTION

The present invention relates generally to a winch apparatus. More particularly, but not by way of limitation, the winch apparatus may be used to place a line in tension. The line may include fiber optic cable, power lines, barbed wire, tethers, threaded lines made of any of known appropriate materials, and the like.

Presently, when a user wishes to tension a line, he or she must estimate the approximate tension on the line as the line is tightened. In some applications, it can be quite important to accurately ascertain the amount of tension in the line as the line is tightened.

BRIEF SUMMARY OF THE INVENTION

The present disclosure relates to a winch apparatus and a method of use thereof. In one embodiment, the winch apparatus may include a frame having a support end with a support coupler mounted thereto. The support coupler may be configured to couple to a support. An axle may be mounted to the frame of the winch apparatus. At least one sensor may be connected to the axle, the sensor configured to detect strain in the axle and output a corresponding signal. A spool may be rotatably disposed around the axle. The spool may include at least one ratchet wheel and a receiving surface. The winch apparatus may further include an elongate flexible member received on the receiving surface and secured to the spool. A handle may include a grip end and a mounting end opposite the grip end. The mounting end of the handle may be rotatably mounted to the frame. The handle may be configured to actuate the spool and increase tension on the elongate flexible member. A pawl may be mounted to the handle and positioned to actuate the ratchet wheel.

An alternative embodiment of a winch apparatus may include a frame with an axle mounted to the frame. A spool may be rotatably disposed around the axle. A ratchet wheel may be connected to the spool. A handle may be rotatably mounted to the frame with a pawl mounted to the handle. The pawl may be configured to rotate the ratchet wheel upon actuation of the handle. An elongate flexible member may be secured to the spool such that the elongate flexible member is wound around the spool upon rotation of the ratchet wheel. A sensor may be disposed on the axle and configured to detect a change in the axle that corresponds to a tension force in the elongate flexible member. An indicator may be operably coupled to the sensor, the indicator configured to provide an indication corresponding to the tension force in the elongate flexible member.

Alternative embodiments may include the sensor including a strain gauge. Another alternative embodiment may include the axle having an axial bore, where the strain gauge sensor is located within the axial bore. One embodiment may include a display unit operably coupled to the at least one sensor and configured to provide a visual display corresponding to the signal. Another embodiment may include an alarm operably coupled to the at least one sensor and configured to provide an audible output corresponding to the signal. Yet another embodiment may include the ratchet wheel and the spool being formed as a single part. Still another embodiment may include a controller operably coupled to the at least one sensor and configured to receive the signal output from the at least one sensor and output a corresponding indication signal. The embodiment may further include an indicator operably coupled to the controller and configured to receive the indication signal and provide an indication corresponding to the indication signal. The controller may also be configured to convert sensed values output by the sensor into indication values output to the indicator. Another embodiment includes the indicator including a screen configured to provide a visual display corresponding to the signal. Yet another embodiment includes the indicator including a warning lamp configured to illuminate when the amount of tension in the elongate flexible member reaches a predetermined amount. Still another embodiment includes the indicator including an alarm configured to sound when the amount of the tension in the elongate flexible member reaches a predetermined amount.

The present disclosure also relates to a method of tensioning a line. In one embodiment, the method includes providing a mechanical winch having a support coupler and a tensioner coupler. The support coupler may be connected to a support. The tensioner coupler may be connected to a line to be tensioned. Tension may be applied to the line through actuation of a ratcheting wheel and a spool of the mechanical winch, thereby applying strain to an axle of the spool. The strain in the axle may be detected as a result of the tension applied to the line. An output may be provided corresponding to the tension applied to the line.

Alternative embodiments of the method of tensioning a line may include converting the detected strain in the axle into an output with a controller. Another embodiment may include displaying the output visually or indicating the output audibly.

Numerous objects, features, and advantages of the present invention will be readily apparent to those skilled in the art upon a reading of the following disclosure when taken in conjunction with the accompanying drawings.

DETAILED DESCRIPTION

Various embodiments of the present invention will now be described with reference to the accompanying drawings. Many embodiments are contemplated. The disclosure should not, however, be construed to be limited to the embodiments set forth herein.

Figure 1:
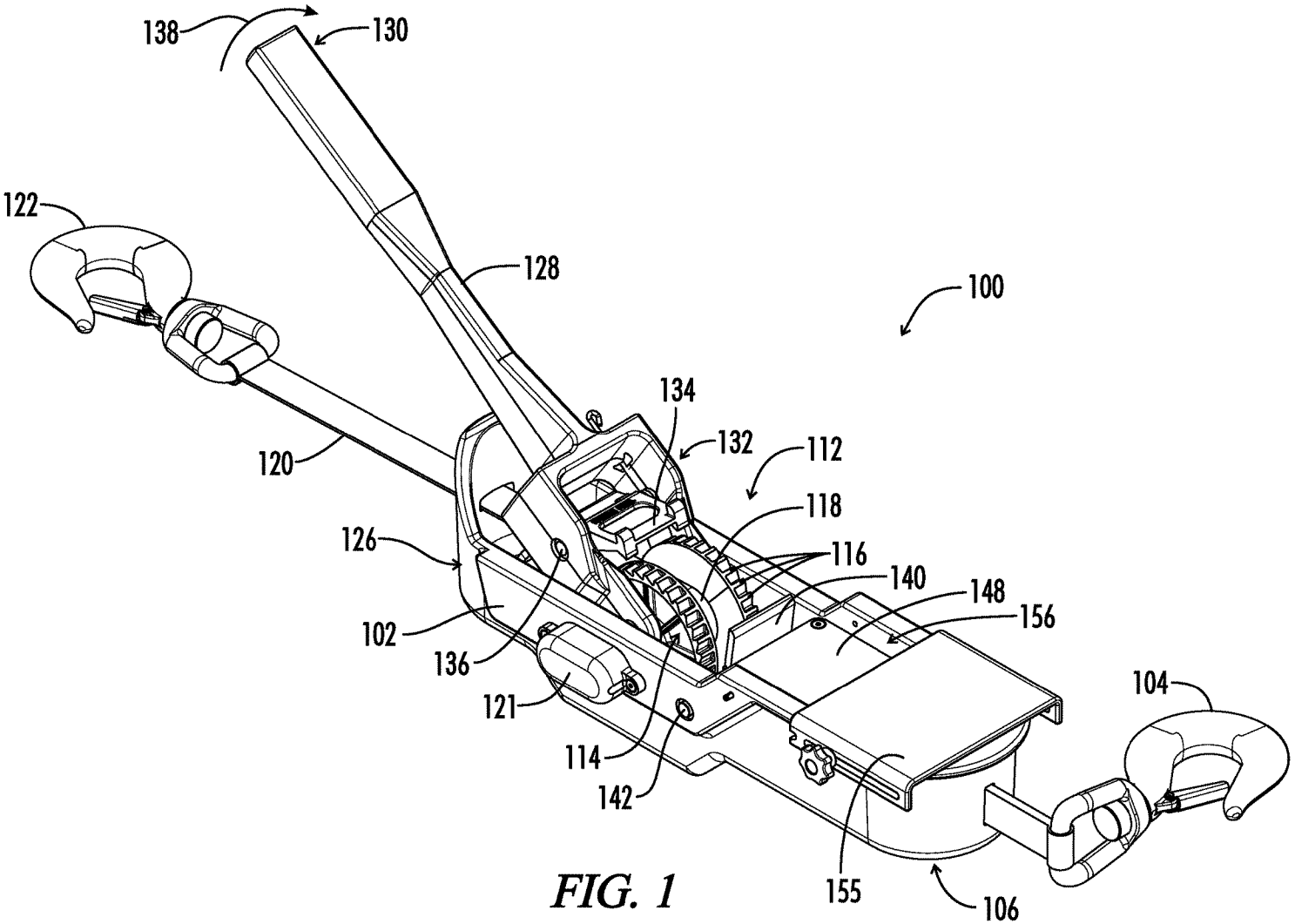
FIG. 1 shows a perspective view of one embodiment of the winch apparatus.

In one embodiment, a winch apparatus 100 is provided for use in placing a line in tension while accurately ascertaining the amount of tension in the line at any given moment during the tensioning operation. FIG. 1 is a perspective view of one embodiment of the winch apparatus 100. The winch apparatus 100 includes a frame 102 made of any appropriate material with enough strength to withstand the forces experienced by the winch apparatus during use. The frame 102 may be made of one or many of a variety of metals. Alternatively, the frame 102 may be made of plastic, fiberglass, Kevlar, any other polymer, or of some composite material. More specifically, but not by way of limitation, the frame 102 may be made of a resin-alloy material. The frame 102 can be made of a material that has electrically insulative properties. One such electrically insulative resin-alloy material is produced as MIR-1000-95 by Mirteq, an Australian company with a plant located in Fort Wayne, Ind.

A support coupler 104 may be mounted to the frame 102 at a support end 106 of the frame. The support coupler 104 is configured to couple to a support (not shown) and can be any sort of hook, clamp, or other fastener that can be selectively coupled and decoupled from a support. The support coupler 104 can be made of any suitable material, including, but not limited to, metals, polymers, and composites. One embodiment of the winch apparatus 100 includes a support coupler 104 coated with or made of plastic, Kevlar, fiberglass, other polymers, or a composite. The support may be any stationary object or any member already coupled to a stationary object. The support could be a stake secured to the ground, a pole, or a line coupled to the pole, for instance.

Figure 4:
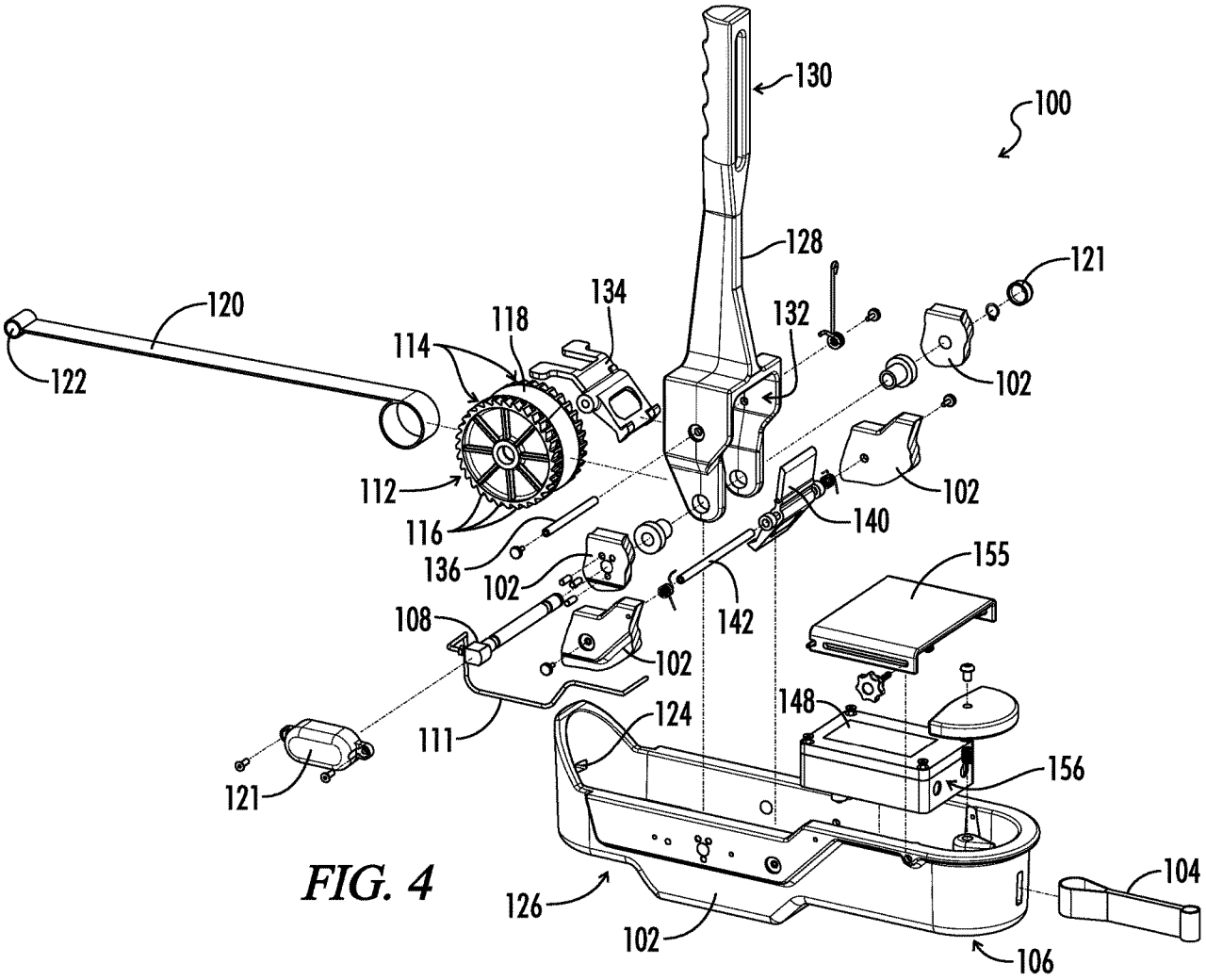
FIG. 4 shows an exploded perspective view of the winch apparatus of FIG. 1.
Figure 5:
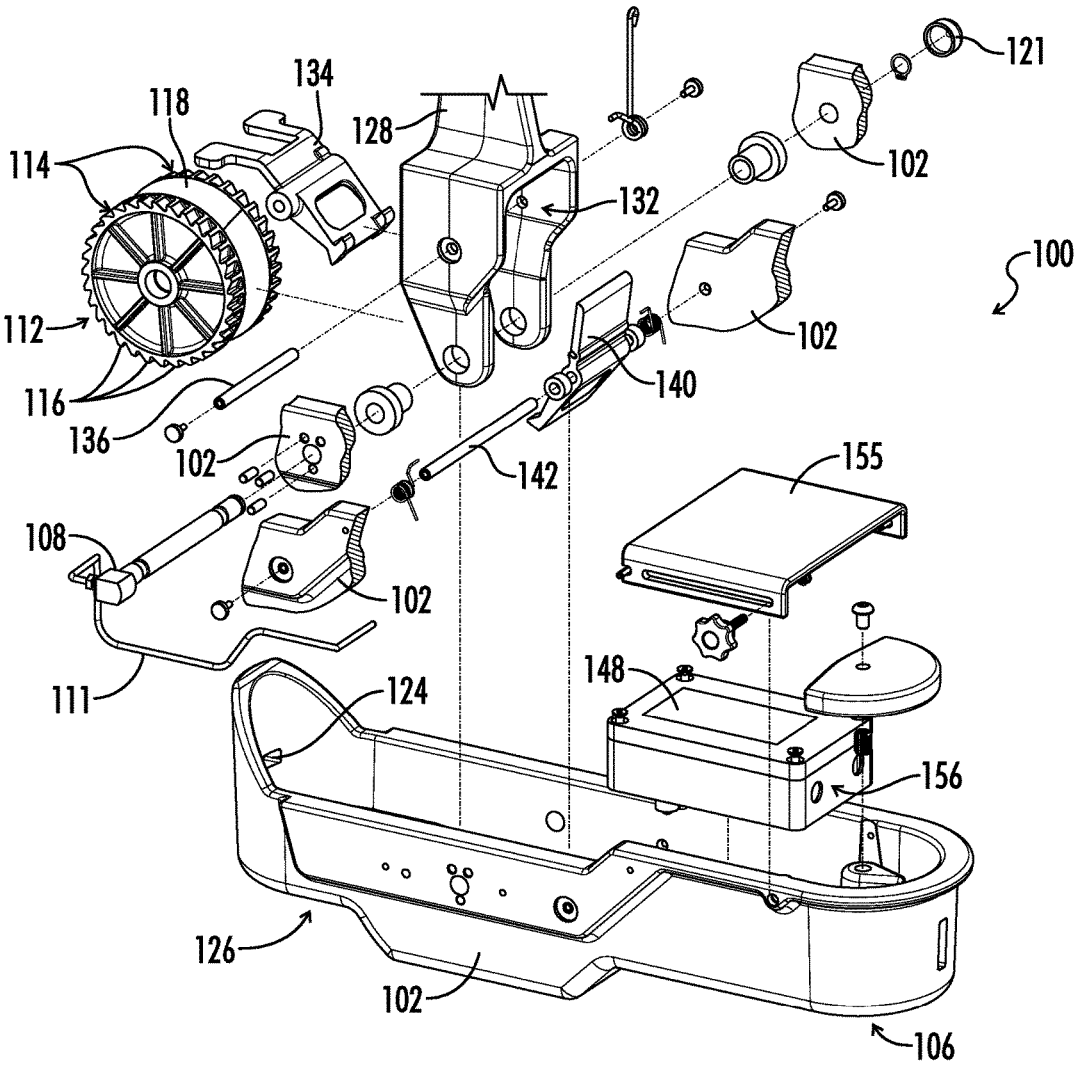
FIG. 5 shows a detailed exploded perspective view of the middle portion of the winch apparatus of FIG. 1.
Figure 6:
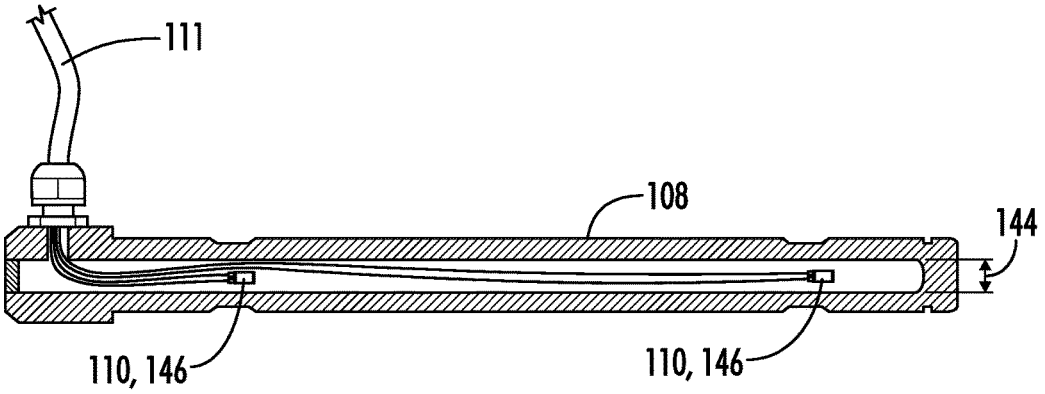
FIG. 6 shows a cross-sectional view of an axle of an embodiment of the winch apparatus.
Figure 7:
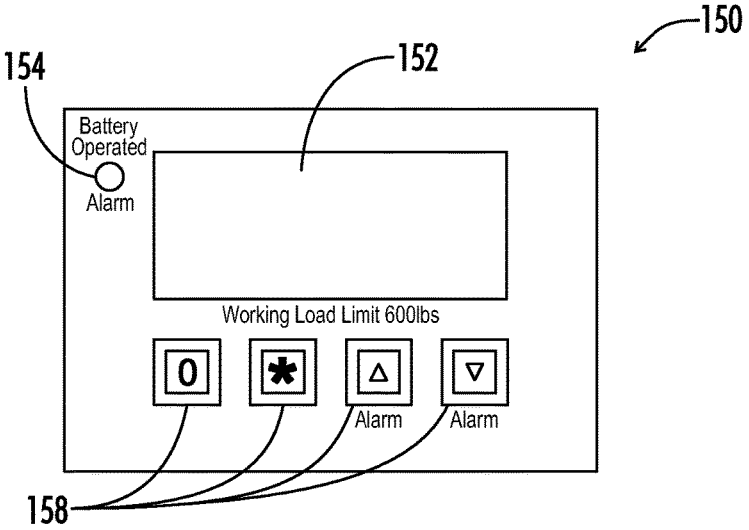
FIG. 7 shows an example of a visual display included in one embodiment of the winch apparatus.

As shown in FIG. 4 and FIG. 5, an axle 108 is mounted to the frame 102. The axle 108 may be rotatably mounted to the frame 102, or it may be fixed to the frame. As shown in FIG. 6, for instance, at least one sensor 110 is connected to the axle 108 and is configured to detect a strain in the axle and output a corresponding signal over a communication line 111. The sensor 110 may be any appropriate sensor including, but not limited to, strain gauge sensors, pressure sensors, translational movement sensors of any type, accelerometers, and the like.

A spool 112 is rotatably disposed around the axle 108. The spool 112 may rotate with the axle 108, or the spool may rotate as the axle remains fixed. The spool 112 includes a ratchet wheel 114. The ratchet wheel 114 may be, without adding limitation, an integral part of the spool 112, molded with the spool, or simply coupled to the spool in any known manner. The ratchet wheel 114 may, without adding limitation, also include a surface with a series of teeth 116, a friction inducing surface (not shown), or some combination of the two. The ratchet wheel 114 may be disposed on one side, both sides, or as an integral part of the spool 112. The spool 112 also includes a receiving surface 118 of any appropriate design so as to receive an elongate flexible member 120. The receiving surface 118 may simply be a continuation of the surface of the ratchet wheel 114, or it may be a groove, indentation, raised surface, or some other discrete surface from the ratchet wheel disposed next to or in between the surface(s) of the ratchet wheel. The axle 108 may be sized such that it does not protrude from the outside of the frame 102. If the axle is sized such that it protrudes from the outside of the frame 102, the winch apparatus may include one or more caps 121 that cover the ends of the axle. Caps 121 may be coated with or made of any suitable material. One embodiment includes caps 121 made of or coated with plastic, Kevlar, fiberglass, other polymers, or some other composite. The caps 121 may be made to be electrically insulative. Other protrusions that may influence the electrically insulative properties of the winch apparatus 100 may also be covered with a similar material.

The elongate flexible member 120 may be a cable, wire, line, rope, strap, or the like secured to the spool and including a coupler 122 at the free end of the flexible member. The coupler 122 may then be used to couple to the line to be tensioned (not shown). The coupler 122 can be made of any suitable material, including, but not limited to, metals, polymers, and composites. One embodiment of the winch apparatus 100 includes a coupler 122 coated with or made of plastic, Kevlar, fiberglass, other polymers, or a composite. The elongate flexible member 120 may be constructed of a non-absorbent, electrically insulative material. Such material may include plastic, Kevlar, fiberglass, other polymers, or a composite. A non-limiting example of the elongate flexible member 120 is BioThane coated webbing (polyester webbing with a TPU or PVC coating that makes it more durable, waterproof, easy to clean, and weldable). The elongate flexible member 120, however, may also be the line itself that is to be tensioned. The elongate flexible member 120 may be secured to the spool 112 by way of a fastener (not shown) connecting or holding the elongate flexible member to the spool, or it may be secured to the spool by being wrapped on itself a number of times around the spool prior to tightening further with the use of the winch apparatus 100. The elongate flexible member 120 may pass through an opening 124 in the frame 102 at a tensioning end 126 of the frame.

A handle 128 is configured to actuate the spool 112 in order to increase tension on the elongate flexible member 120. The handle 128 may be made of any suitable material, including those mentioned above with regard to the frame 102. The handle 128 has a grip end 130 to be engaged by a user's hand. The grip end 130 may be shaped such that it is ergonomic or otherwise shaped to receive a user's hand. The grip end 130 may be shaped as part of the handle 128 itself, or it may be an added part to be fastened to the handle to provide a suitable grip. The handle 128 also includes a mounting end 132 opposite the grip end 130. The mounting end 132 is rotatably mounted to the frame 102. The mounting end 132 may be a bifurcation of the handle 128 in order to mount to the frame 102 at two locations. The handle 128 may also simply be a single-piece bar that is mounted to the frame 102 at one end. The handle 128 may mount directly to the frame 102 in a rotatable fashion, for instance, with pins or bolts (not shown). The handle 128 may also mount to the axle 108 and be rotatable about the axle if the axle is fixed.

A drive pawl 134 is mounted to the handle 128 and is biased so as to actuate the ratchet wheel 114. The drive pawl 134 may be rotatably mounted to the handle 128, for instance, at a drive pawl rod 136. The drive pawl 134 may be rotatably mounted to the handle 128 such that it rotates freely away from the ratchet wheel 114 when the handle is being actuated in one direction and is prevented from rotating past a predetermined point when the handle is being actuated in the opposite direction, i.e. the tensioning direction 138. The drive pawl 134 may also be a resilient member that is allowed to deflect away from the ratchet wheel 114 when the handle 128 is being actuated in one direction and is prevented from deflecting beyond a certain degree when the handle is being actuated in the tensioning direction 138. The drive pawl 134 may be of any suitable shape so as to slide past the ratchet wheel 114 while the handle 128 is being actuated in one direction toward the tensioning end 126 and engage and actuate the ratchet wheel while the handle is being actuated along an arcuate path toward the support end 106 in a tensioning direction 138 of the handle actuation.

A brake pawl 140 may be rotatably mounted to the frame 102, for instance, at a brake pawl rod 142. The brake pawl 140 is biased so as to actuate the ratchet wheel 114. Interaction of the brake pawl 140 with the ratchet wheel 114 prevents unwinding of the spool 112 when the handle 128 is actuated in the direction toward the tensioning end 126.

In one embodiment, when an operator desires to relieve tension applied to the elongate flexible member 120, the operator fully actuates the handle 128 in the tensioning direction 138. If a large amount of tension has been applied to the elongate flexible member 120, it is necessary to disengage the drive pawl 134 from the ratchet wheel 114. Such disengagement allows the handle 128 to rotate independently of the spool 112 without applying any additional tension to the elongate flexible member 120. When the handle 128 has been fully actuated in the tensioning direction 138, the drive pawl 134 contacts the brake pawl 140. Interaction between the drive pawl 134 and the brake pawl 140 causes the brake pawl to also become disengaged from the ratchet wheel 114. Disengagement of the drive pawl 134 and the brake pawl 140 allows the spool 112 to rotate freely and relieves tension applied to the elongate flexible member 120.

The embodiment may include other features, as well. For instance, as shown in FIG. 6, the axle 108 may include an axial bore 144, and a strain gauge sensor 146 may be located within the axial bore. A plurality of strain gauge sensors 146 may also be located within the axial bore. A non-limiting example of the axle can be found in U.S. Pat. No. 3,695,096 to inventor Ali Umit Kutsay, the contents of which are incorporated herein by reference.

Figure 2:
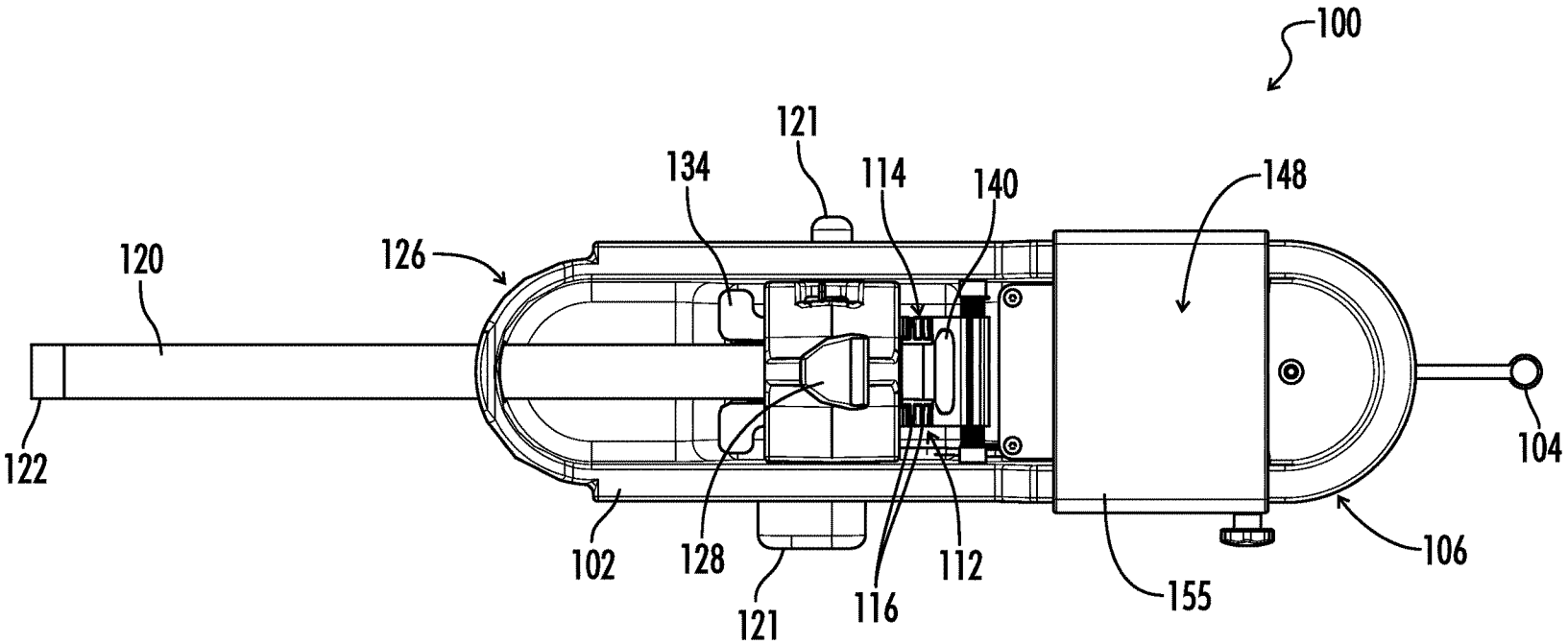
FIG. 2 shows a top view of the winch apparatus of FIG. 1.
Figure 3:
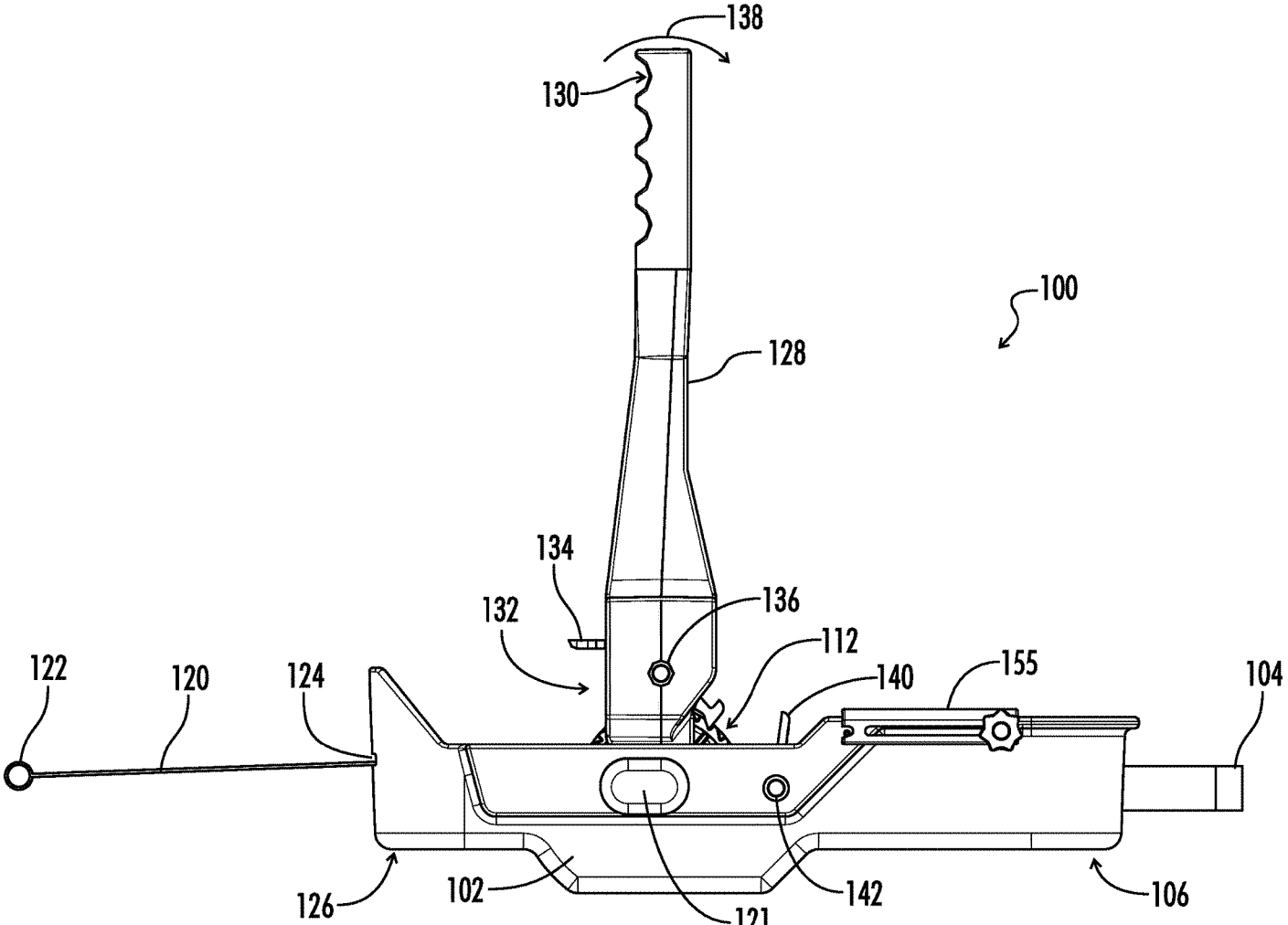
FIG. 3 shows a side view of the winch apparatus of FIG. 1.

In one embodiment, a display unit 148 is operably coupled to the at least one sensor 110. The display unit 148 is configured to provide a visual display 150 corresponding to the signal provided from the sensor 110 through communication line 111. The display unit 148 may include a screen 152 of any type, including but not limited to LED, LCD, plasma, and other known screen configurations. The display unit 148 may include one or more user actuated controls 158, for example, a touch screen, one or more buttons, keyboard, or other user interface, to allow for configuration of the settings of the display unit such as, but not limited to, units of measurement, type of display, zeroing/taring the device, the predetermined value at which the device may indicate a warning, powering on and off the device, and the like. The display 150 may also include a warning lamp 154 that illuminates when the signal provided through communication line 111 is beyond a certain value or when the tension in the elongate flexible member 120 reaches a predetermined amount. The display 150 may include multiple screens 152 or warning lights 154. The display 150 may further include a needle (not shown) configured to move in correspondence with the signal. Any method of displaying a signal may be used if it is suitable for indicating the amount of tension in the flexible elongate member to a user. The display unit 148, as well as any other sensitive electronic parts, may optionally be partially or completely surrounded with a packing material to avoid damage due to an impact from, for example, dropping the winch apparatus 100. The packing material may be any suitable material that provides some level of shock absorbent characteristics to the assembly. One such suitable material, for example, is a Poron urethane foam manufactured by Rogers Corporation. The display unit 148 may also be secured by, or simply partially or completely covered by, a screen guard 155 or other protective material. If a screen guard 155 is included in an embodiment, it may optionally be retracted to allow access to the display unit 148. As an illustrative and non-limiting example, the screen guard 155 is shown retracted in FIG. 1 and is shown covering display unit 148 in FIG. 2 and FIG. 3.

In another embodiment, an alarm 160 is operably coupled to the at least one sensor 110 and is configured to provide an audible output corresponding to the signal output through communication line 111 from the sensor. The alarm 160 may include any form of vibration producing instrument, including, but not limited to, a speaker. The alarm 160 may sound when a predetermined signal value is reached or when the amount of the tension in the elongate flexible member 120 reaches a predetermined amount. The alarm 160 may also be a voice indicating the corresponding signal output through communication line 111. In one embodiment, a plurality of indicators may be utilized, including a display unit 148 and an alarm 160. The display unit 148 may include a touch screen, buttons, or other such controls 158 to configure settings including, but not limited to, volume of the alarm 160, type of alarm, predetermined value at which the alarm sounds, language of the voice, and the like.

Figure 8:
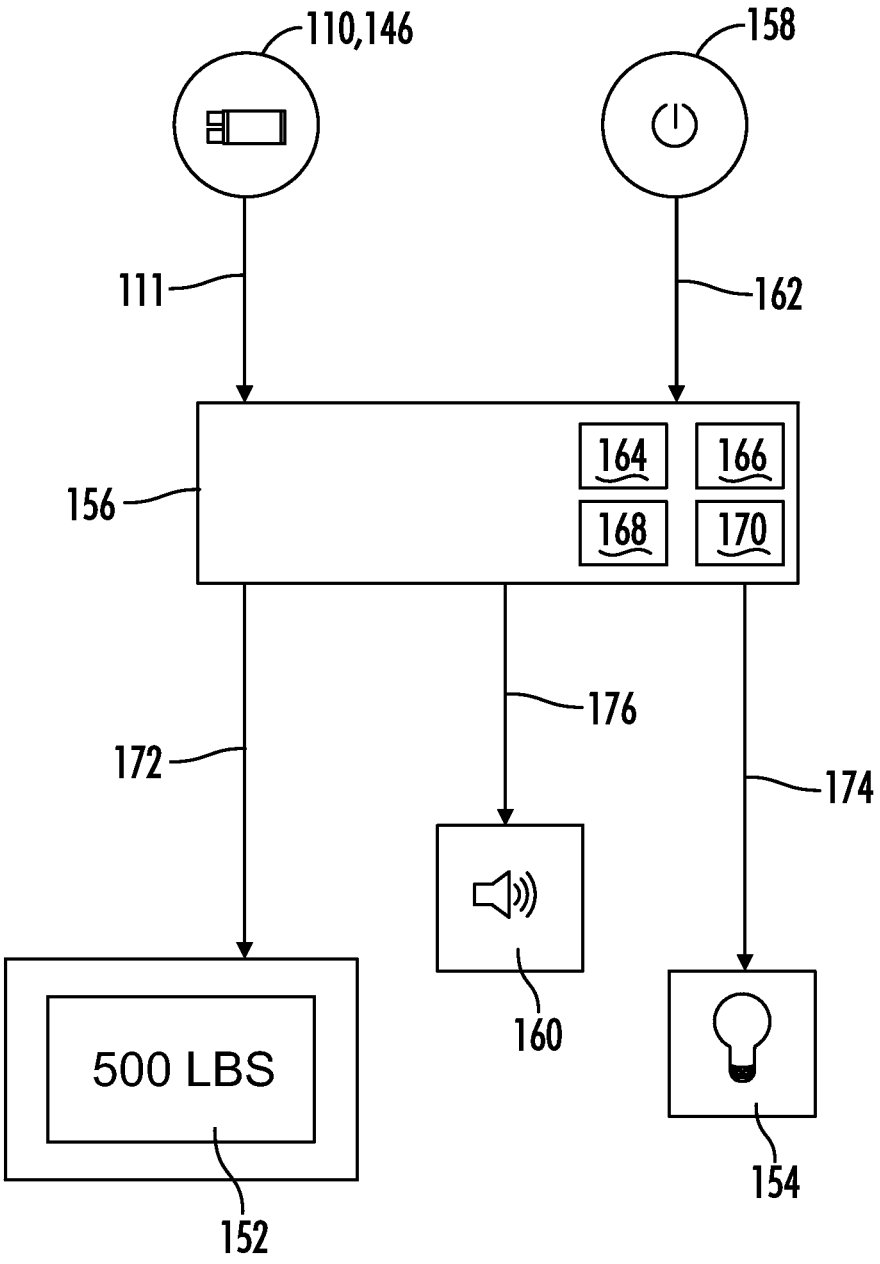
FIG. 8 shows a control schematic for an embodiment of the winch apparatus.

As shown in FIG. 8, in yet another embodiment, a controller 156 may be operably coupled to the at least one sensor 110 and configured to receive the signal transmitted through communication line 111 output from the at least one sensor and receive another signal transmitted through communication line 162 output (or not output) from user actuated controls 158, respectively. The user actuated controls 158 allow for a human operator to input instructions into the controller 156. It is understood that the controller 156 described herein may be a single controller having all of the described functionality, or it may include multiple controllers wherein the described functionality is distributed among the multiple controllers.

In an embodiment, the controller 156 as described herein may refer to, or be embodied by, a computing system that includes a processor 164, a computer readable memory medium 166, a data base 168, and an input/output module or control panel having a display (shown as user actuated controls 158 and screen 152, respectively).

The term "computer-readable memory medium" as used herein may refer to any non-transitory medium 166 alone or as one of a plurality of non-transitory memory media within which is embodied a computer program product 170 that includes processor-executable software, instructions, or program modules which, upon execution, may provide data or otherwise cause a computer system to implement subject matter or otherwise operate in a specific manner as further defined herein. It may further be understood that more than one type of memory media may be used in combination to conduct processor-executable software, instructions, or program modules from a first memory medium upon which the software, instructions, or program modules initially reside to a processor for execution.

"Memory media" as generally used herein may further include without limitation transmission media and/or storage media. "Storage media" may refer in an equivalent manner to volatile and non-volatile, removable and non-removable media, including at least dynamic memory, application specific integrated circuits (ASIC), chip memory devices, optical or magnetic disk memory devices, flash memory devices, or any other medium which may be used to stored data in a processor-accessible manner, and may unless otherwise stated either reside on a single computing platform or be distributed across a plurality of such platforms. "Transmission media" may include any tangible media effective to permit processor-executable software, instructions or program modules residing on the media to be read and executed by a processor, including without limitation wire, cable, fiber-optic and wireless media such as is known in the art.

In another embodiment, a controller 156 may not be or otherwise require a computing system, but may be separately embodied by, or otherwise independently configured within a machine, such as a general purpose processor, a digital signal processor (DSP), an application specific integrated circuit (ASIC), a field programmable gate array (FPGA) or other programmable logic device, discrete gate or transistor logic, discrete hardware components, or any combination thereof designed and programmed to perform or cause the performance of the functions described herein. A general purpose processor can be a microprocessor, but in the alternative, the processor can be a microcontroller, or state machine, combinations of the same, or the like. A processor can also be implemented as a combination of computing devices, e.g., a combination of a DSP and a microprocessor, a plurality of microprocessors, one or more microprocessors in conjunction with a DSP core, or any other such configuration.

Depending on the embodiment, certain acts, events, or functions of any of the algorithms described herein in accordance with a controller 156 can be performed in a different sequence, can be added, merged, or left out altogether (e.g., not all described acts or events are necessary for the practice of the algorithm). Moreover, in certain embodiments, acts or events can be performed concurrently, e.g., through multi-threaded processing, interrupt processing, or multiple processors or processor cores or on other parallel architectures, rather than sequentially.

The controller 156 may be configured to receive the incoming signal transmitted across communication line 111 from the at least one sensor 110 and output a corresponding, but different, signal to a visual display 150 and/or an alarm 160. The controller 156 may be configured to convert sensed values output by the sensor 110 into indication values to be output to the indicator (display unit 148 and/or alarm 160). A non-limiting example may be such that the controller 156 receives a signal through communication line 111 indicating the amount of strain detected by at least one strain gauge sensor 146 connected to the axle 108 and, via calibration or some other calculation, translates the signal into a corresponding signal that indicates the amount of tension that is experienced by the elongate flexible member 120. An indicator (display unit 148 and/or alarm) may be operably coupled to the controller 156 and configured to receive the indication signal and provide an indication corresponding to the indication signal. The indicator may be, without adding limitation, of any type contemplated above. In a particular but non-limiting example, the controller 156 may be configured to receive the incoming signal from the at least one sensor 110 through communication line 111 and the incoming signal (or lack thereof) from the user actuated controls 158 through communication line 162. The controller may also be configured to output control signals to one or a combination of a screen 152 through communication line 172, a warning lamp 154 through communication line 174, and an alarm 160 through communication line 176.

An embodiment of a winch apparatus 100 may include a frame 102, an axle 108 mounted to the frame, a spool 112 rotatably disposed around the axle, a ratchet wheel 114 connected to the spool, a handle 128 rotatably mounted to the frame, a pawl 134 mounted to the handle and configured to rotate the ratchet wheel upon actuation of the handle, an elongate flexible member 120 secured to the spool such that the elongate flexible member is wound around the spool upon rotation of the ratchet wheel, a sensor 110 disposed on the axle and configured to detect a change in the axle corresponding to a tension force in the elongate flexible member, and an indicator (display unit 148 and/or alarm) operably coupled to the sensor and configured to provide an indication corresponding to the tension force in the elongate flexible member.

A method of tensioning a line may include providing a mechanical winch 100 having a support coupler 104 and a tensioner coupler 122; connecting the support coupler to a support of some kind; connecting the tensioner coupler to a line to be tensioned; applying tension to the line through actuation of a ratcheting wheel 114 and a spool 112 of the mechanical winch, thereby applying strain to an axle 108 of the spool; detecting the strain in the axle as a result of the tension applied to the line; and providing an output corresponding to the tension applied to the line. Providing an output corresponding to the tension applied to the line may include conversion of the detected strain in the axle 108 into an output with a controller 156. The output provided may be displayed visually, indicated audibly, or both. The contemplated method may or may not use the embodiment of the winch apparatus 100 shown in the Figures.

The above disclosure is capable of numerous rearrangements, modifications, and substitutions. Thus, although there have been described particular embodiments of the present disclosure of a winch apparatus, it is not intended that such references be construed as limitations upon the scope of this disclosure except as set forth in the following claims.

What is claimed is:

1. A winch apparatus comprising:
- a frame having a support end;
- a support coupler mounted to the support end and configured to couple to a support;
- an axle mounted to the frame;
- at least one sensor connected to the axle and configured to detect strain in the axle and output a corresponding signal;
- a spool rotatably disposed around the axle, the spool including:
  - a ratchet wheel; and
  - a receiving surface;
- an elongate flexible member received on the receiving surface and secured to the spool;
- a handle configured to actuate the spool and increase tension on the elongate flexible member, the handle including:
  - a grip end; and
  - a mounting end opposite the grip end, the mounting end rotatably mounted to the frame; and
- a pawl mounted to the handle and positioned to actuate the ratchet wheel.

2. The apparatus of claim 1, wherein the sensor includes a strain gauge.

3. The apparatus of claim 2, wherein:
- the axle has an axial bore; and
- the strain gauge is located within the axial bore.

4. The apparatus of claim 1, further comprising:
- a display unit operably coupled to the at least one sensor and configured to provide a visual display corresponding to the signal.

5. The apparatus of claim 1, further comprising:
- an alarm operably coupled to the at least one sensor and configured to provide an audible output corresponding to the signal.

6. The apparatus of claim 1, wherein the ratchet wheel and the spool are formed as a single part.

7. The apparatus of claim 1, further comprising:

a controller operably coupled to the at least one sensor and configured to receive the signal output from the at least one sensor and output a corresponding indication signal;

an indicator operably coupled to the controller and configured to receive the indication signal and to provide an indication corresponding to the indication signal.

8. The apparatus of claim 7, wherein the indicator includes a screen configured to provide a visual display corresponding to the signal.

9. The apparatus of claim 7, wherein the indicator includes a warning lamp configured to illuminate when the amount of the tension in the elongate flexible member reaches a predetermined amount.

10. The apparatus of claim 7, wherein the indicator includes an alarm configured to sound when the amount of the tension in the elongate flexible member reaches a predetermined amount.

11. A winch apparatus comprising:

a frame;

an axle mounted to the frame;

a spool rotatably disposed around the axle;

a ratchet wheel connected to the spool;

a handle rotatably mounted to the frame;

a pawl mounted to the handle and configured to rotate the ratchet wheel upon actuation of the handle;

an elongate flexible member secured to the spool such that the elongate flexible member is wound around the spool upon rotation of the ratchet wheel;

a sensor disposed on the axle and configured to detect a change in the axle corresponding to a tension force in the elongate flexible member; and an indicator operably coupled to the sensor and configured to provide an indication corresponding to the tension force in the elongate flexible member.

12. The apparatus of claim 11, wherein the ratchet wheel and the spool are a single part.

13. The apparatus of claim 11, wherein the indicator includes a display screen.

14. The apparatus of claim 11, wherein the indicator includes an indicator lamp.

15. The apparatus of claim 11, wherein the indicator includes an alarm.

16. The apparatus of claim 11, further comprising:

a controller operably coupled to the sensor and the indicator, the controller configured to convert sensed values output by the sensor into indication values output to the indicator.

17. A method of tensioning a line, the method comprising:

(a) providing a mechanical winch having a support coupler and a tensioner coupler;

(b) connecting the support coupler to a support;

(c) connecting the tensioner coupler to a line to be tensioned;

(d) applying tension to the line through actuation of a ratcheting wheel and a spool of the mechanical winch, thereby applying strain to an axle of the spool;

(e) detecting the strain in the axle as a result of the tension applied to the line; and (f) providing an output corresponding to the tension applied to the line.

18. The method of claim 17, wherein step (f) includes converting the detected strain in the axle into an output with a controller.

19. The method of claim 17, wherein step (f) includes displaying the output visually.

20. The method of claim 17, wherein step (f) includes indicating the output audibly.

* * * * *